United States Patent [19]

Shaw

[11] Patent Number: 4,550,364

[45] Date of Patent: Oct. 29, 1985

[54] POWER TRANSFORMER FOR USE WITH VERY HIGH SPEED INTEGRATED CIRCUITS

[76] Inventor: William S. Shaw, P.O. Box 180579, Austin, Tex. 78718

[21] Appl. No.: 617,386

[22] Filed: Jun. 5, 1984

[51] Int. Cl.[4] ..... H01F 27/24

[52] U.S. Cl. ..... 363/24; 336/212; 336/215

[58] Field of Search ..... 363/24; 336/178, 212, 336/215, 223, 232, 200, 173, 174, 182, 183, 184, 217, 219

[56] References Cited

U.S. PATENT DOCUMENTS

| | | | |
|---|---|---|---|
| 4,092,621 | 5/1978 | Nyswander et al. | 336/184 |
| 4,176,333 | 11/1979 | Bennon et al. | 336/215 |
| 4,460,885 | 7/1984 | Hansen et al. | 336/182 |
| 4,507,640 | 3/1985 | Rich, III et al. | 336/223 |

*Primary Examiner*—Peter S. Wong
*Assistant Examiner*—Judson H. Jones
*Attorney, Agent, or Firm*—Pravel, Gambrell, Hewitt & Kimball

[57] ABSTRACT

A low voltage switching power supply designed to be compact and efficient for use with very high speed integrated circuits (VHSIC) has an innovative output transformer. Designed for use at greater than 50 KHZ (typically 100 KHZ) the transformer is box-like in shape of high permeability ferrite material having one to four rectangular channels containing the primary and secondary winding. The secondary is electroplated copper with very low resistance while the primary is copper tape of some sixteen nominal turns. The power capability is 500 Watts with the output at 5 Volts DC or less and has an efficiency of greater than 98 percent. Up to three transformers can be paralleled to give a total output power of 1500 Watts.

19 Claims, 9 Drawing Figures

POWER TRANSFORMER FOR USE WITH VERY HIGH SPEED INTEGRATED CIRCUITS

BACKGROUND OF THE INVENTION

The invention relates to a power transformer suitable for use in switching power supplies intended for use with very high speed integrated circuit (VHSIC) applications, wherein the drive is by pulse width modulation at a frequency of 50,000 Hertz or more.

It is desirable to have a compact, low-loss manufacturable power transformer able to operate over wide temperature ranges with no change in characteristics. As size gets smaller, efficiency must be very high (greater than 98 percent) since the loss (as heat) must be dissipated from a small volume. Effective heat transfer methods must be used to sustain continuous operation. A high input-to-output turns ratio, which is related to the input voltage (115 VAC or 220 VAC) to output voltage (approximately 2 VDC) ratio, requires unique winding materials and techniques to maintain a high quality transformer having minimum copper loss and low leakage inductance (less than 1 $\mu$H).

SUMMARY OF THE INVENTION

To minimize the volume of the transformer without reducing the efficiency, it is considered desirable that output resistance also be minimized. This is structurally difficult because to reduce the output resistance, a large volume of copper or other conductive winding is required which, in turn, reduces the space available for primary windings. It is thus considered important to configure the transformer so that the output resistance and volume are both reduced without sacrificing capacity. This is accomplished by providing a volumetrically efficient configuration which is a box-shaped parallelepiped provided with channels having a rectangular cross section. In addition, by utilizing a ferrite material suitable for transformers of this type which has a high resistivity (ceramic Magnetics type MN60), the resistance of the secondary is reduced by electrodepositing a copper coating on the ferrite (made non-conductive by coating) and delineating the secondary's path by means of separating the coating to provide one turn for each channel, the current flowing in opposite directions on the outer surfaces as compared to the flow within the channels adjacent thereto. The primary windings are preferably coils of copper tape or ribbon which are wound around the copper coating secondary through the channels provided in the body of magnetic material. Current flows in such channels, induced by the primary winding, in opposite directions.

Electrodepositing the copper secondary provides a space-efficient, low-loss winding that can easily be attached to an output bus structure by reflow soldering without increasing leakage inductance.

The preferred embodiment has two primary and two secondary coils with a center tap for each side. On the secondary side, silicon diodes are provided for rectifying the current and a capacitor together with inductors are provided to smooth the output voltage.

The resulting transformer is 98 percent or more efficient and such heating as occurs due to core loss is rapidly dissipated by the large surface area of the plated secondary, minimizing an increase in the ferrite core temperature. The transformer is also volumetrically efficient and, in fact, is very small for a transformer having its output power (500 Watts) at the relatively high frequencies (typically 100KHZ) involved. Compared to other transformers for the same purpose, the transformer of this invention is advantageous in that it costs less, operates more efficiently and effectively, weighs less, and is easier to manufacture. Moreover, the lower weight means simplier mounting structures to withstand shock and vibration than previous designs.

Other adaptabilities and capabilities of the invention will be understood by those skilled in the art from the following disclosure of the invention, reference being had to the accompanying drawings, in which:

DESCRIPTION OF THE PREFERRED EMBODIMENTS

Figure 1:
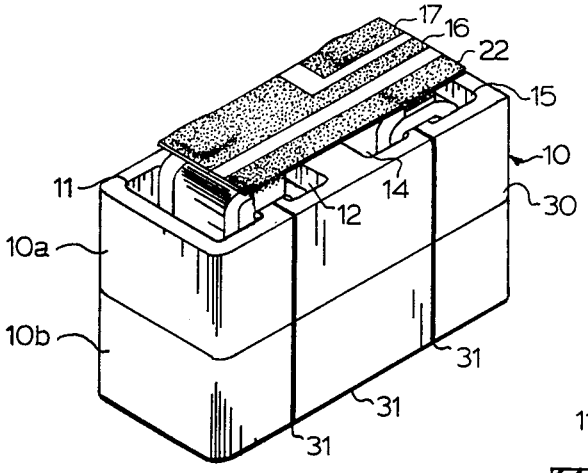
FIG. 1 is a perspective of a transformer in accordance with the invention.
Figure 2:
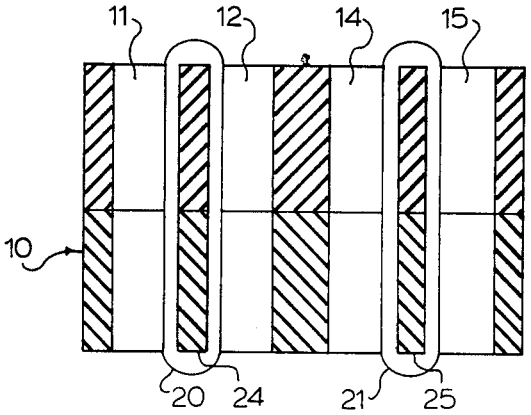
FIG. 2 shows the transformer of FIG. 1 in cross section.

Referring to FIGS. 1–3 and 7, the transformer core 10 has a configuration of a box-shaped parallelepiped and is provided with four channels 11, 12, 14 and 15 which extend completely through core 10 and have identical configurations of rectangular horizontal cross section. Primary coils 20 and 21 which comprise three to thirty turns of copper tape extend into channels 11 and 12, and 14 and 15 respectively, around interior portions 24 and 25 respectively of core 10.

Coils 20 and 21 are connected in series by the connection to the center tap member 22.

Figure 3:
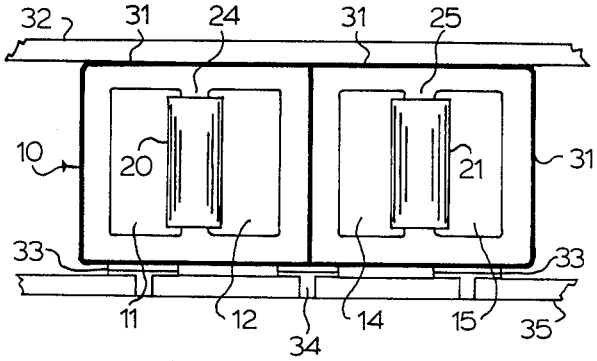
FIG. 3 is an end view of the transformer shown in FIGS. 1 and 2 in a receptacle for same.
Figure 4:
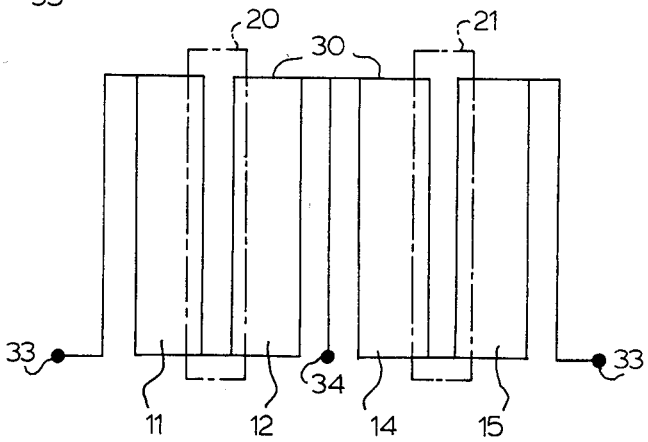
FIG. 4 diagramatically depicts the relationship of the primary and secondary coils of the transformer.
Figure 7:
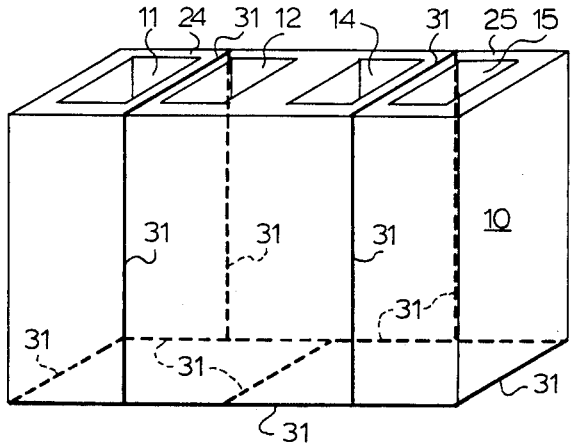
FIG. 7 is an isometric view depicting the configuration of the core and secondary coating thereon of the transformer shown in FIGS. 1–3.

Core 10 has a deposited secondary winding comprising a conductive coating 30. Winding 30 may be of any suitable electrically conductive material and is about 0.005 to 0.02 inches in thickness. Normally winding 30 is a copper deposition and may be applied in the same manner as described in U.S. Pat. No. 3,123,787 of Mar. 3, 1964 to Shifrin. The configuration of the secondary is governed by the placement of grooves or slits 31 which are so disposed to provide a secondary path for the current as shown in FIG. 4 whereby essentially the current goes in one direction in channel 11 and in the opposite direction in adjacent channel 12. The direction of the current flow at channel 14 corresponds to channel 11 and, in the same manner, the direction of the current flow in the outboard channel 15 corresponds to that in channel 12. As seen in FIG. 3, slits 31 isolate the openings from channels 11 and 12 vis-a-vis those of 14 and 15 on the lower end of core 10 whereas as seen in FIGS. 1 and 7, the slits 31 extend from the lower end up to divide the upper edges of portions 24 and 25 and back down again to the horizontal lower slits 31 on the opposite side. Thus the path of electrical current in the secondary windings 30 must be through channels 11, 12, 14 and 15. This, of course, corresponds to the disposition of coils 20 and 21 around portions 24 and 25.

When secondary windings 30 have been plated on core 10 and the primary windings or coils installed around portions 24 and 25, attachment to the high current secondary is accomplished by mating same to busses 33 and center tap bus 34 as shown in FIG. 3. These are contained in a receptable 32 which, also, has at its other end contacts for the primary center tap member 22 as well as for its pulse voltage contact 16 and the return voltage contact 17. Busses 33 and 34 may be resiliently urged against the secondary conductive coating 30 or permanently attached thereto by reflow soldering.

Figure 5:
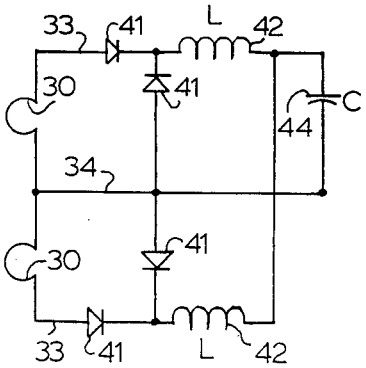
FIG. 5 is a winding diagram of a power supply utilizing the transformer of the instant invention.

As seen in FIG. 5, the pulse width modulated (PWM) drive 35 is 180° out of phase with the PWM drive 36 so that the switching devices are turned "on" and "off" alternately. Both devices are never "on" at the same time so that the maximum duty cycle is 50 percent. The primary center tap 22 is biased at one-half the high voltage (+HV) value. When drive 35 is "on" a voltage is impressed across winding 20 equal to one-half the high voltage. A voltage is induced at the secondary 30. A switching voltage from leads 33 is rectified by diodes 41 and smoothed by an inductor 42, capacitor 44 filter. The output voltage is available across capacitor 44. In the same way, drive 36 is turned "on" when drive 35 is "off" which impresses an equal voltage across winding 21 and winding 31 as before which is also rectified by diodes 41 and filtered by inductor 42 and output capacitor 44. Drives 35 and 36 can both be "off" simultaneously and the percentage of "off" time is determined by the load demanded by the output. The less the load, the longer both 35 and 36 are "off".

Figure 6:
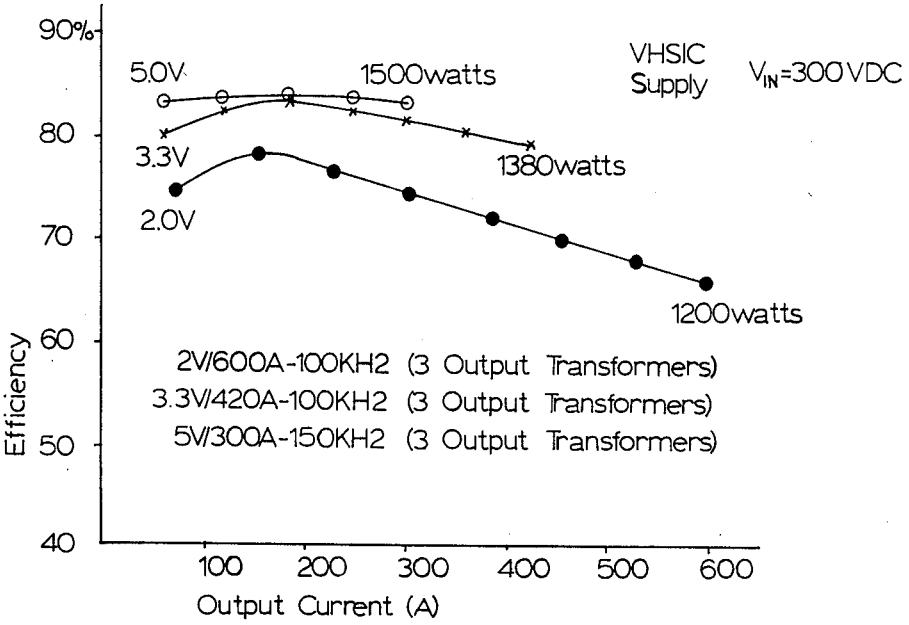
FIG. 6 is a graph of the efficiency of the power supply circuit shown in FIG. 5 at different voltages and frequencies.

As previously indicated, the transformer is 98 percent or more efficient. The efficiency of the entire power supply is, of course, somewhat less as shown in FIG. 6. Thus using an input voltage of 300 VDC, with an output voltage of about 2 VDC, the typical efficiency is 70 percent. With the output voltage of 3.3 VDC it is consistently above or about 80 percent. With 5 VDC output at 150 KHZ the output is consistently above 82 percent. The efficiences shown were measured with a supply using three output transformers.

Figure 9:
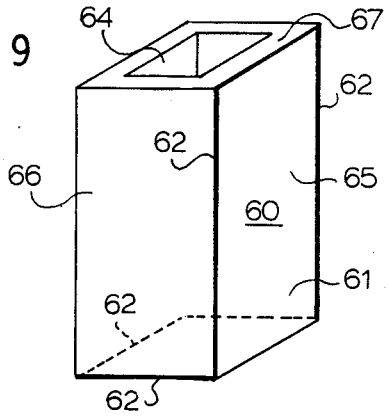
FIG. 9 is an isometric view of still another transformer core with the secondary plated thereon.
Figure 8:
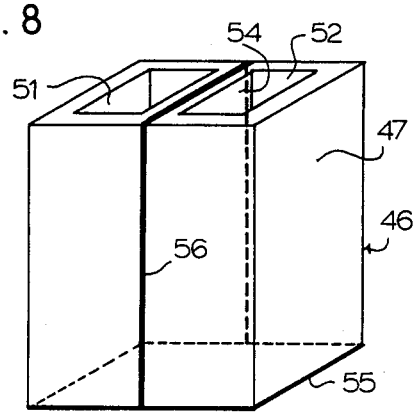
FIG. 8 is an isometric view of another configuration for the core and secondary coating thereon.
Figure 8:
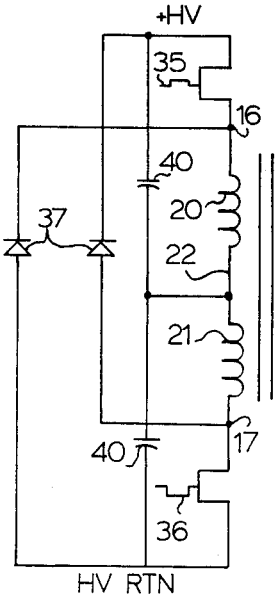

FIGS. 8 and 9 disclose other embodiments of the core and secondary coating. Thus the core 46 in FIG. 8 substantially comprises one-half of the core disclosed with reference to FIGS. 1–3 and 7. Such core 46 has a continuous coating 47 of copper or other conductive material which is not only on the outer surfaces of core 46 but also as in the previous embodiment on the surfaces of the channels 51 and 52 therethrough. Core 46 is a box-shaped parallelepiped and its two channels 51 and 52 are identical and also are of a box-shaped parallelepiped configuration. Channels 51 and 52 are divided by a portion 54 which is integral with core 46 and defines a rectangular surface in both channels 51 and 52. At the bottom of core 46 a rectangular slit 55 is provided in the coating 47 and is joined by an inverted U-shaped further slit 56 on both sides which extends across the top of portion 54. Accordingly, any electric current having its terminals on opposite sides of slit 56 in contact with or attached to coating 47 must travel through both channels 51 and 52. A coil such as coils 20 and 21 (not shown in FIG. 8) is received around portion 54, such coil being a primary to induce the flow of current in channels 51 and 52. It will be appreciated that, with proper connections which are well known within the skill of one having the instant disclosure before him, two cores 46 with coils such as coils 20 and 21 around portions 54 function essentially the same as core 10 in the circuitry disclosed with reference thereto and, in FIG. 5 in particular. However, core 46 has the additional advantage of presenting a further surface along one outer side for the dissipation of heat.

FIG. 9 discloses a further ferrite core 60 having an electrically conductive coating 61 divided by an endless slit 62 which encircles one side and the bottom of core 60. Thus the electrical coating 61 is divided into two conductive outer regions which are connected by channel 64. The core and secondary shown in FIG. 9 is essentially identical to what would result by cutting through core 10 just inboard of a vertical slit 31 across portion 24.

The two electrically conductive outer regions may be identified by reference numerals 65 and 66. Electrical contact to region 65 are joined by the conductive surfaces constituting the vertical part of region 65 and the coated surfaces of channel 64. Thus a coil, such as coils 20 and 21, received in channel 64 and around portion 67 adjacent to the vertical surface of region 65 has the capacity to induce an electrical current in the secondary as defined by channel 64, the vertical surface of region 65 as well as region 66. Two such cores and secondaries as shown in FIG. 9 with coils such as coils 20 and 21 applied thereto and properly connected will function in essentially the same manner in the circuit shown in FIG. 5 as two cores 46 together with the secondary and primary windings or a single core 10 together with the secondary and primary windings as disclosed. The primary advantage of the core and secondary shown in FIG. 9 is its compactness.

Preferably all edges and corners of the cores together with the electrically conductive coatings thereon are rounded and the slits around edges constitute, in effect, bevelled edges. The copper coating is preferably covered by a thin further coating such as tin in an amount sufficient to prevent oxidation of the copper. As previously indicated, the copper coating is relatively thin, from 0.005 to 0.02 inches in thickness. The copper taped primary windings are also of a thin gage, 0.002 to 0.005 inches and have a width equal to the longer width of channels 11, 12 14 and 15 less about 0.05 inches on each side. Normally the primary has sixteen turns but this depends upon the voltage applied to the primary coils. The cores may be manufactured in one or more ferrite layers. Thus the core shown in FIG. 1 has upper and lower layers **10*a* and 10*b* which are bonded together using super glue (Eastman 910) with the plating being applied over such bonding whereby it is continuous from layer "a" to layer "b". The length of core 10 is 1.94 inches. Its height is 1.22 inches and its width is 0.88 inches. The longer width of each of the channels as shown in FIG. 3 is 0.63 inches and the shorter width is 0.25 inches. The width of each portion 24 and 25 is 0.25 inches as is the division part between channels 12 and 14**.

From the foregoing, it will be appreciated that the transformer in accordance with the invention is relatively small for 500 Watts output. One advantage of the secondary winding being a plating is that substantially all of the space provided by the channels is available for the primary windings. The box-shaped parallelepiped configuration is volumetrically efficient and may be obtained from a pressing mold designed for same. The result is a power transformer suitable for high efficiency, low output voltage supplies having the necessary operational characteristics, shape, winding ratios and a very low output winding resistance.

The attached drawings are reasonably proportional to the disclosed embodiments although other configurations may be employed.

It will be appreciated that although I have described the preferred embodiments of my invention, it is capable of other adaptations and modifications within the scope of the appended claims.

Having thus disclosed my invention, what I claim as new and to be secured by Letters Patent of the Unitd States is:

1. A transformer for frequencies greater than 50 KHZ which comprises:

a parallelipiped shaped core of ferrite material of high resistivity having two parallelepiped shaped side-by-side channels therethrough, a portion of said core extending between said channels;

a primary winding extending through said channels and around said portions; and a secondary winding comprising an electrically conductive coating on the surfaces of said core including the surfaces thereof defining said channels and the surfaces of said portion, said coating having a first slit around the openings for said channels on one end of said core and a second slit which extends normally from a first connection to said first slit proximate said portion to the other end of said core where it extends across said portion and returns to a second connection with said first slit at a location proximate said portion and opposite said first connection, and electrical leads to said secondary winding being in contact with said conductive coating on opposite sides of said second slit on said core.

2. A transformer in accordance with claim 1 wherein said parallelepiped shapes include parallelogram faces which are substantially rectangular.

3. A transformer in acccordance with claim 2 wherein said primary winding comprises copper tape.

4. A transformer in accordance with claim 2 wherein said electrically conductive coating comprises an electro-deposited copper plating.

5. A transformer in accordance with claim 4 wherein said plating has a substantial uniform thickness in the range of 0.005 to 0.02 inches.

6. A transformer in accordance with claim 5 wherein said second slit traverses opposite faces of said core.

7. A transformer in accordance with claim 6 wherein there is a further core similar to said first mentioned core having similar primary and secondary windings, said further core being integral with said first mentioned core along a side of each said core so that said opposite faces of said core are coplanar surfaces interrupted by their respective said second slits.

8. A transformer in accordance with claim 7 wherein said respective second slits of said cores are parallel throughout.

9. A transformer in accordance with claim 2 wherein said first slit extends along the corners and edges of said one end.

10. A transformer in accordance with claim 9 wherein said integrated core has a length greater than its height.

11. A transformer which comprises:

a parallelepiped shaped core of magnetic material suitable for a transformer which provides low reluctance for magnetic flux and has a high resistivity, a parallelepiped shaped channel with oppositely disposed openings for a channel extending through said magnetic material, said core and said channel having parallel outer and inner surfaces respectively;

a primary winding extending at least along said inner and outer surfaces which are parallel to each other so that the material between such inner and outer surfaces is encircled by said primary windings; and a secondary winding comprising electrically conductive coatings on the surfaces of said core including the surfaces thereof defining said channel, said coatings being continuous except that gaps are provided in said coating so that said inner surfaces connect through the respective said openings of said channel with said outer surfaces which are otherwise electrically separated by said gaps and current flows generally in opposite directions in said inner and outer surfaces in response to electromagnetic induction caused by current flowing in said primary winding.

12. A transformer in accordance with claim 11 wherein said primary winding comprises a continuous tape wound in a spiral, the edges of said tape at the respective sides of said coil being coplanar.

13. A transformer in accordance with claim 12 wherein said coatings comprise copper which has been electroplated on said core.

14. A transformer in accordance with claim 13 which comprises a further core similar to said first mentioned core, said further core being integral with said first mentioned core vby being joined therewith along outer surfaces along which said primary winding extends, said channel in said further core extending parallel adjacent said outer surface along which said primary winding extends and receiving said primary windings so that said primary winding extends through the channel in said first mentioned core and also through the channel in said further core.

15. A low voltage DC power supply for use with very high speed integrated circuits having a pulse width modulated constant frequency of at least 50 KHZ which comprises a transformer having high voltage windings and low voltage secondary windings, the core of said transformer being box-shaped and having two pairs of parallel channels extending therethrough, each said pair of channels defining between them an elongated portion, said secondary windings comprising an electrically conductive coating on the exterior and through the channels of said core, said primary windings comprising two tape coils received through said channels and wound individually around each of said portions, said integrated circuit connected to said primary and driving same with high voltage width modulated pulses of typically up to five microseconds in duration, a further circuit connected to said secondary winding comprising a center tap between said coils and conductors on opposite sides of said coils from said center tap which each include rectifier means and inductors after said conductors are joined, the direct current output extending from between said center tap and said conductors after they are joined, a capacitor being provided between said center tap and said joined conductors.

16. A power supply in accordance with claim 15 wherein said rectifier means comprise silicon diodes and said inductors are respectively in series therewith, furter conductors containing further silicon diodes connecting said center tap to each of said first mentioned conductors between the diodes and inductors therein.

17. A power supply in accordance with claim 15 wherein said electrically conductive comprise electrodeposited copper of a thickness of 0.005 to 0.02 inches and said tape coils each comprise coper ribbon, said coatings being separated so that each primary coil acts on effectively a single turn of the secondary windings.

18. A power supply in accordance with claim 17 wherein each primary tape coil has between twenty and thirty turns.

19. A power supply in accordance with claim 18 wherein said tape in said coils is effectively of about eighteen gage thickness.

* * * * *